United States Patent [19]

Gundersen

[11] Patent Number: 4,607,701

[45] Date of Patent: Aug. 26, 1986

[54] TREE CONTROL MANIFOLD

[75] Inventor: Dag H. Z. Gundersen, Ventura, Calif.

[73] Assignee: Vetco Offshoe Industries, Inc., Ventura, Calif.

[21] Appl. No.: 667,317

[22] Filed: Nov. 1, 1984

[51] Int. Cl.[4] ..... E21B 33/038; E21B 34/04

[52] U.S. Cl. ..... 166/368; 166/344; 251/149.7; 137/594

[58] Field of Search ..... 166/332, 338, 344, 345, 166/368, 351, 360; 251/149.6, 149.7, 143; 137/594, 595

[56] References Cited

U.S. PATENT DOCUMENTS

| | | | |
|---|---|---|---|
| 4,109,712 | 8/1978 | Regan | 166/332 |
| 4,469,136 | 9/1984 | Watkins | 251/149.6 |
| 4,476,934 | 10/1984 | Regan | 166/368 |
| 4,497,369 | 2/1985 | Hurta et al. | 166/368 |

*Primary Examiner*—Stephen J. Novosad
*Assistant Examiner*—Bruce M. Kisliuk
*Attorney, Agent, or Firm*—Joseph R. Dwyer

[57] ABSTRACT

Disclosed is a manifold control system 80 for a completion tree 10 comprising a manifold plate 92 having a plurality of single port or multi-port two position spring biased piston type valve cartridges 82 mounted thereon, which individually route hydraulic control signals to the various valve and connector operators 14,18 and 30. The two position spring biased piston type valve cartridge thus performs the function of a tree cap and eliminating the need for the latter, and thus eliminating running/retrieval operations required for tree closure and control hook up during installation workover and retrieval. These valve cartridges are detachably connected to the plate and may be replaced, whole or in part, subsea; their number and type selectable according to the needs of the tree; in a workover mode cooperate with a running tool and in a production mode automatically close the cartridges and control lines to seawater, debris and the like.

13 Claims, 14 Drawing Figures

TREE CONTROL MANIFOLD

BACKGROUND OF THE INVENTION

This invention relates, in general, to completion, production or injection trees for producing oil and gas from a subsea well and is specifically directed to a completion tree having a new and improved manifold control system.

Although a typical prior art completion tree will be described in more detail in the Detailed Description hereinafter, for the purposes of understanding the background to the invention, suffice to say here that, typically a completion tree is equipped to be locked onto the wellhead of a subsea well and comprises essentially a series of valves, sometimes with valve operators, for connecting production and other tubing within the well to subsea flowlines which bring the well production to the production platform or to shore. A tree manifold at the top of the tree provides the junction point for all hydraulic control functions and interfaces with a tree cap during production and with a running tool during installation of the tree and re-entry to the well for workover. Both the tree cap and the running tool are equipped with stingers or stabs which enter pockets in the tree manifold and, through the stinger, direct the flow of hydraulic fluid (control signals) to various valve operators, the flowline connector, the wellhead connector, etc. The number of valve operators in the tree depends on; the tubing program, the number of stingers, whether or not the tree is to be a through flowline (TFL) type, whether or not access to the annulus is to be provided, and whether or not special features are required, such as chemical injection, etc.

Usually the completion tree is assembled at the surface and landed at the wellhead with the running tool being connected at the tree manifold. The running tool provides surface operated control lines with access to the wellhead connector for hydraulically actuating and connecting the tree onto the wellhead and also allows other functions to be accomplished, including access to the production tubing, the annulus tubing through control of the tree valves and control of subsea safety valve(s) conventionally located 50–200 feet below the tubing hanger.

After the completion tree is in place and connected to the wellhead, the running tool is disconnected, brought to the surface and the tree cap is connected thereto. Thereafter the running tool and tree cap are lowered so that the tree cap is then connected to the tree manifold. It is the tree cap that directs the hydraulic control signals from a bundle of control lines (umbilical) connected to the tree cap to the various valve operators. This function of the tree cap is sometimes referred to as a U-function since the signals from one port in the tree manifold are directed through the tree cap to another port in the manifold to the valve operators.

During production, the tree cap and normally a tree cap protector are in place on the manifold and production is out the side of the tree to the subsea flowlines.

If re-entry to the well for workover is desired, the running tool is lowered to remove the tree cap protector and tree cap and after bringing them to the surface is again run and stabbed on to the tree manifold to control the tree valve operators from the surface to perform whatever work is necessary to the well.

A major disadvantage with the present system as above described is that when the tree cap is removed from the tree manifold and before the running tool can be landed, seawater intrusion and contamination of the control circuits can result. Also, during the periods when neither the tree cap nor the running tool are connected to the tree manifold, the completion tree is completely divorced from the surface and thus out of control. Further, the number of running operations involving costly rig time required for closure of the production tree with a tree cap providing the U-function and subsequent retrieval for access is higher than required with this invention.

SUMMARY OF THE INVENTION

The invention which overcomes the disadvantages mentioned above comprises a new and improved manifold control system for a completion tree in the form of a manifold plate having a plurality of control valve cartridges mounted thereon. These control valve cartridges are, single port or multi-port, two position spring biased shuttle (piston) type valves, which separately route hydraulic control signals to the various valve operators thus performing the function of the tree cap and eliminating the need for the latter. These control valve cartridges are detachably connected to the manifold plate and may be replaced, whole or in part, subsea.

In the production mode, since the stingers of the tree cap are no longer available, hydraulic signals from the subsea umbilical, or control manifold center, are directed through the control valve cartridges to the valve operators while the spring bias maintains valve piston in one position.

In the workover mode, the U-functions of the control valve cartridges are interrupted by the running tool stingers which engage these valve pistons, overcome the spring bias and move the pistons to a second position whereby fluid from the surface control is directed to the valve operators for a workover control access to the tree.

Not all of the control valve cartridges are used since access to swab valves and the wellhead tree connector, for example, are not necessary during production mode, these spring biased valve cartridges do provide a hydraulic block condition acting as a secondary lock for such components when the tree is in a production mode and the running tool has been removed.

Since there is always a hydraulic interface between the tree manifold system and the subsea umbilical, or control manifold center; since those valve cartridges, not connected to the subsea umbilical, or control manifold center, are blocked when the running tool has been removed; and since control of the tree is maintained with the surface controls when the running tool is in place, there are no intermediate periods between the production mode and the workover mode when the tree is without control. Furthermore, since the subsea umbilical, or control manifold center, is in fact a closed circuit with the valve operators during the production mode and, in direct control from the surface during the workover mode, an emergency disconnect of the running tool with pressurized functions during workover produces a fail-safe closure of the valves due to the operation of the spring bias shuttle in each of the valve cartridges allowing the hydraulic fluid to vent back through the production control unit. This feature overcomes the disadvantage of using regular check valves in the hydraulic interface.

From the foregoing and from a further study of the more detailed drawings and detailed description hereinafter it will be seen by those skilled in the art that the control manifold system for a completion tree of this invention provides the following advantages, some of which have already been mentioned:

1. it eliminates the requirement for a conventional tree cap,
2. it provides a check valve function to ensure minimum control fluid contamination in the control circuit,
3. it allows fail-safe closure of tree valves during workover emergency disconnect,
4. it allows subsea replacement of individual cartridge pistons which includes all seals or allows replacement of individual cartridges themselves which includes all seals and seal surfaces,
5. it allows subsea maintenance via a dive boat without rig utilization,
6. it allows purging of the sea floor control umbilical during workover,
7. it provides control system block on nonfunctioning tree components such as the tree connector when the tree is in tree production mode,
8. it provides control system flexibility, i.e., number of functions,
9. the individual cartridges are floating and have position indication rods for visual status indication, and
10. it reduces the number of running/retrieving operations required for standard tree cap and tree closure equipped trees.

DETAILED DESCRIPTION

Figure 1:
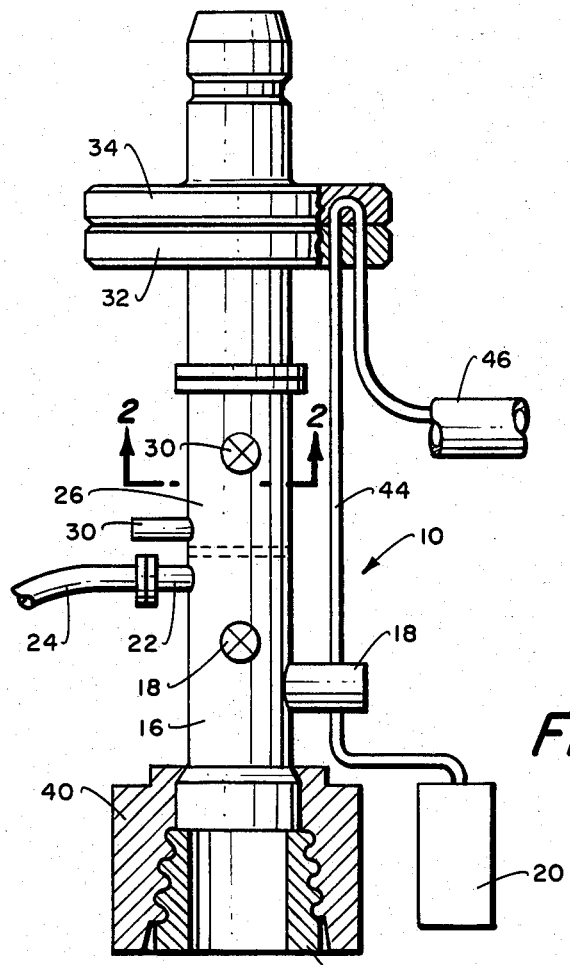
FIG. 1 is a simplified schematic illustration of a subsea completion tree locked on a subsea well with the tree manifold and tree cap enlarged for emphasis.
Figure 2:
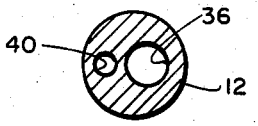
FIG. 2 is a cross-sectional view of a portion of the completion tree taken along line 2—2 of FIG. 1.

In order to illustrate how this invention improved the function and operation of a subsea completion tree, attention is now directed to FIGS. 1-5. Taking first FIG. 1, this drawing illustrates schematically a typical ocean floor completion tree 10 on a well system. The well system conventionally includes a plurality of casing suspended and cemented in place in holes previously drilled through the ocean floor, a tubing hanger supporting production tubing and annulus tubing for producing from the well with a wellhead housing 12 located above guide structures. Since all the above components of a well system are well known, they are not shown except for the wellhead housing 12.

The completion tree 10 is usually made up of a hydraulically actuated wellhead housing connector 14 for connecting the remainder of the tree to the wellhead 12, a master valve block 16 supporting a plurality of production and annulus valves with operators 18 (two shown) and exhaust accumulator 20 (one shown). The master valve block is ported as at 22 to connect the master valve block to a flowline 24 for the production flow from the production tubing, sometimes a swab valve block 26, or a mandrel block, and topped by a tree manifold 32 and, in the production mode, a tree cap 34 and normally a tree cap protector (not shown). (The dotted lines in FIG. 1 between the master valve block 16 and the swab valve block 26 illustrate schematically the fact that the swab valve block is not always used.)

Although shown in the cross-sectional view of the swab valve block only, all of the tree components are provided with multiple bores: a large production bore 36 for communication with the production tubing in the well, and a smaller annulus bore 40 for communication with the annulus. Each component of the tree is provided with suitable nipples and pockets to receive the nipples to connect the bores 36–40 of each component for open communication throughout the length of the tree as the components are stacked and connected to the wellhead. The production and swab valve operators 18 and 30 control the production bore and annulus bore, among other things, direct production fluid out the flowline through the port 22 and these valve operators are connected by control lines 44 (shown only one) to the tree manifold 32.

A bundle of control lines (umbilical) 46 are connected to the tree manifold 32 either directly, or through a valve control manifold (not shown) and the tree cap 34 directs hydraulic fluid under pressure (control signals) from each of the hydraulic control lines of the umbilical 46 to some of the control lines 44 and hence to various production valve operators 18. The function of the tree cap is called the U-function since it directs hydraulic fluid entering one port of the tree manifold, for example, out another port of the tree manifold to the control lines 44 (one shown). On the other hand, a running tool 50 directs such hydraulic fluid from the surface (rig) to the various control lines 44 to all valve operators 18 and 30 as well as to the other hydraulically operated components such as the wellhead connector 14.

Figure 3:
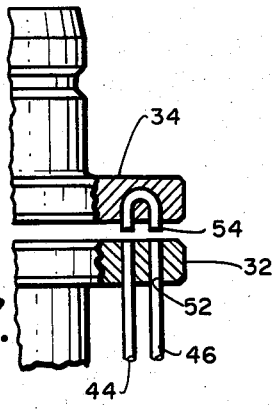
FIG. 3 shows the tree separated from the manifold to show the stingers in the tree cap.
Figure 4:
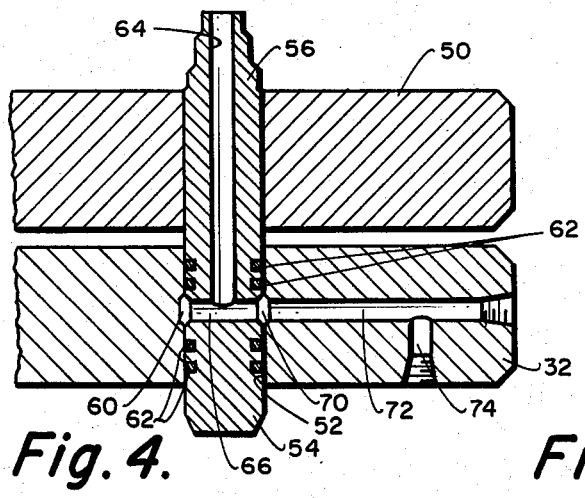
FIG. 4 is an enlarged detailed view of the running tool/tree cap stingers and a portion of the tree manifold.
Figure 14:
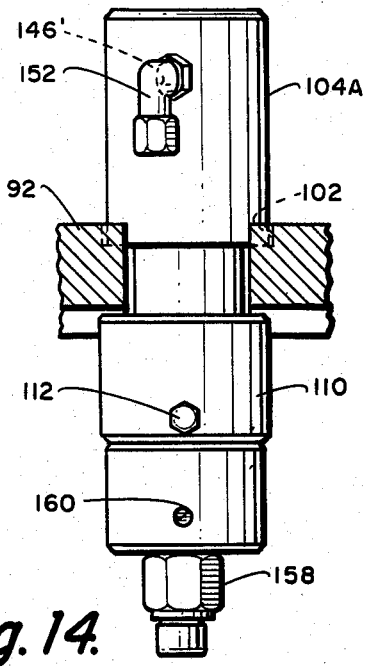
FIG. 14 illustrates a single part valve cartridge.

The tree manifold is provided with pockets 52 to receive stingers 54, sometimes called stabs, from the tree cap 34 shown positioned over the tree manifold 32 in FIG. 3 or from the running tool 50 shown in FIG. 4 as a means of hydraulic interconnection between the tree cap, or running tool, and the tree manifold.

FIG. 4 is an enlarged view of a portion of the tree manifold 32 with one of the stingers 54 of the running tool 50 in place. The tree cap 34 has stingers similar to those of the running tool, but the running tool 50 is illustrated herein by way of example. Each stinger 54 is an elongated spool 56 with a reduced central portion 60 isolated from the ends of the spool by suitable sealing rings 62 lands which sealingly engage the side wall forming the pocket 52. An axial passage 64 in the spool extends to the reduced portion 60 and is connected to a radially outwardly directed port 66 opening into an annulus 70 formed by the reduced portion and the wall of the pocket. This annulus 70 is connected by a radial passage 72 to a vertical passage 74 to one of the control lines.

Figure 5:
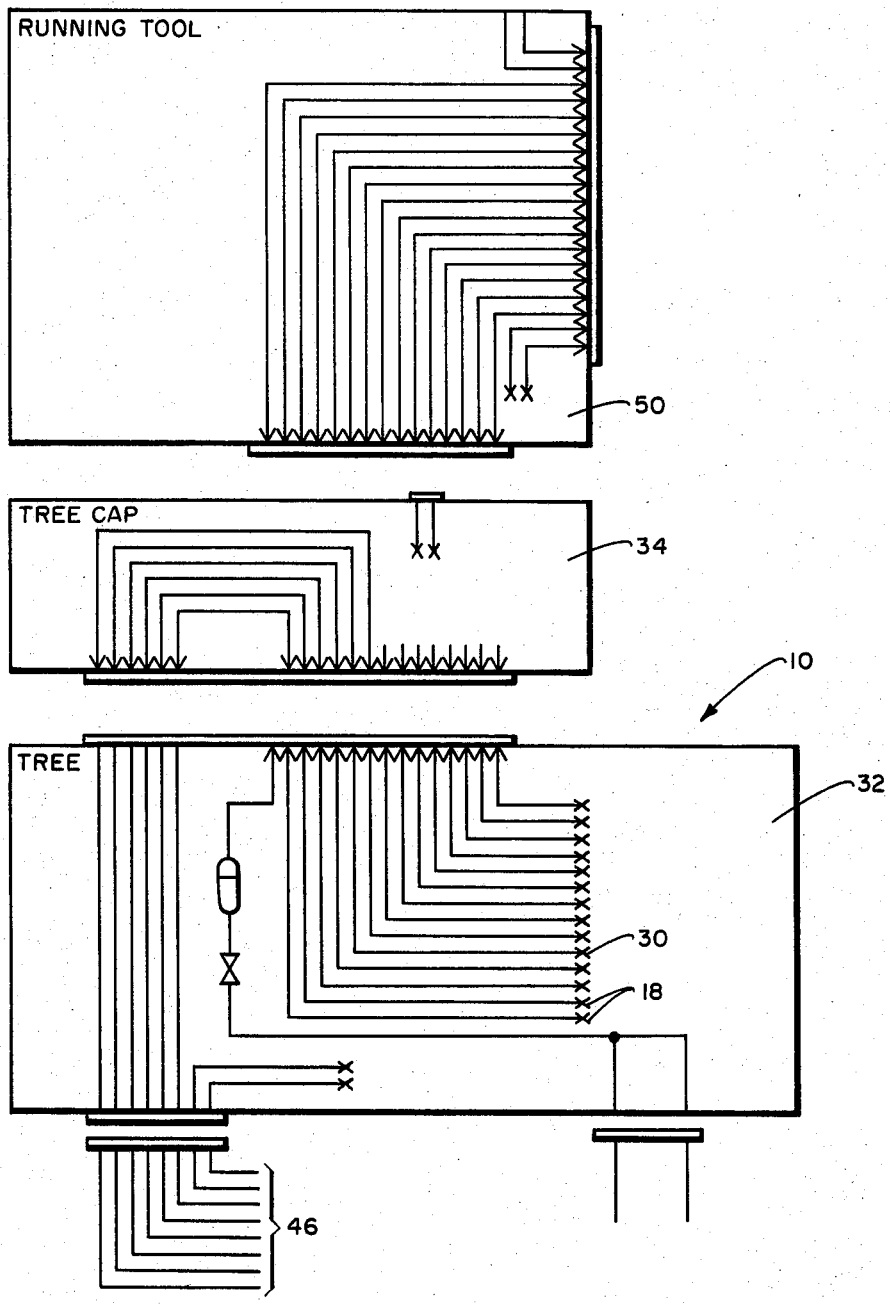
FIG. 5 is a schematic of the hydraulic system for the completion tree with the U-function of the tree cap clearly illustrated.

FIG. 5 is a schematic illustration of the hydraulic lines of the tree cap 34, the hydraulic lines of the running tool 50 relative to the hydraulic lines of the tree manifold 32. It is to be noted that some hydraulic lines in the tree cap are connected in a loop from one pocket of the tree manifold to another pocket in the tree manifold illustrating the above mentioned U-function of the tree cap.

Thus, during production of the well, the control signals (hydraulic fluid under pressure) for the various valve operators 16 are produced on the rig from a control panel and directed through the umbilical 46, first, through the tree manifold 32 and, thence, the tree cap 34 where they are directed back again through the tree manifold 32 to the various production valve operators 18.

When it is desired to work over the well system for whatever reason, the running tool 50 is lowered from the rig to remove a tree cap protector and then the tree cap 34. Then the running tool itself is landed on the tree manifold 32 and the production and swab valve operators 18 and 30 are then controlled through the running tool. As can be seen from this figure, the running tool has direct connection to the various valve operators through the tree manifold and does not contain loops to direct fluid from the umbilical to the tree. Thus, the operator on the workover rig has full and direct control of all valve operators.

The difference between the tree cap and the running tool functions, of course, is that the running tool, among other things, has a direct connection to control the swab valves which is not available to the operator when the tree cap is being utilized. Too, the running tool has a direct connection to such things as the hydraulic control or flowline connector, if used, and connector 14 connecting the tree to the wellhead 12 which is not available in the tree cap to ensure that an inadvertent disconnection of the tree from the wellhead will not take place. Also, the bores 36 and 40 are serviceable through the running tool and not through the tree cap.

As can now be appreciated, the foregoing is a simplified description of a production tree and the manner in which the tree cap and running tool function with the manifold.

The problem with the prior art trees however is that when the tree cap is removed from the tree manifold, all of the control line connections are open to sea and can become contaminated with saltwater, debris, etc. Thus, when the running tool is placed on the tree manifold, or when the tree cap is returned to the tree manifold, as the case may be, the problem of the saltwater, debris, etc., should be dealt with since it may interfere with the proper operation of the production tree. Too, this invention is superior to the use of check valves in the interface as check valves will hydroblock a production valve and subsea safety valve operator if pressurized, thus preventing this to fail safe close in case of an emergency disconnect while applying control pressure through the running tool.

This invention improves the prior art production tree by eliminating the use of the tree cap altogether yet retaining the function of the tree cap in the production tree and further improves the prior art production tree by providing a means by which the tree is under control of the rig operator at all times and by reducing the problem of contamination by saltwater, debris, and the like. The system also reduces the number of running/retrieving operations required in order to establish workover control of the production tree.

Figure 6:
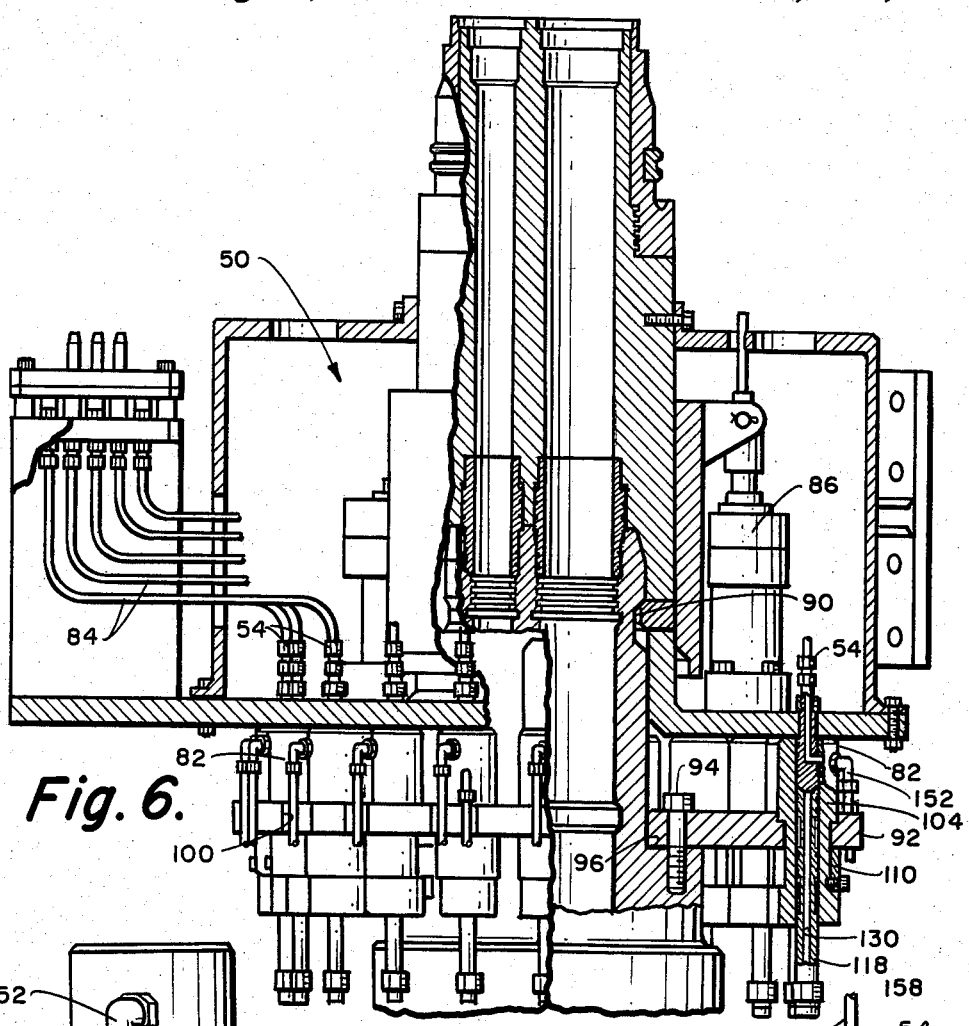
FIG. 6 is an elevational view of the control manifold of this invention with a running tree landed thereon.
Figure 13:
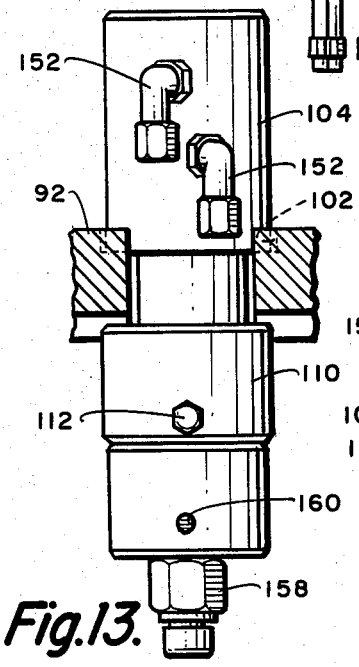
FIG. 13 is an elevational view of the cartridge and support plate taken along line 13—13 of FIG. 9.
Figure 12:
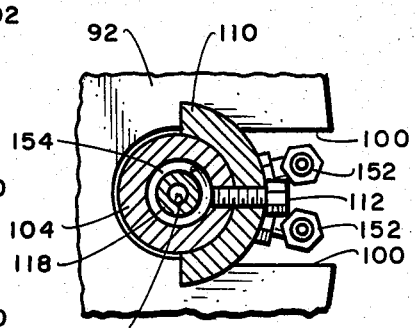
FIG. 12 is a view of the cartridge and support plate taken along line 12—12 of FIG. 10 showing the means for attaching the cartridge to the support plate.
Figure 7:
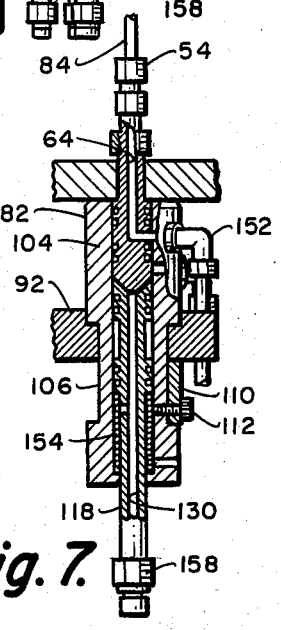
FIG. 7 illustrates a valve cartridge of FIG. 6 in more detail.
Figure 8:
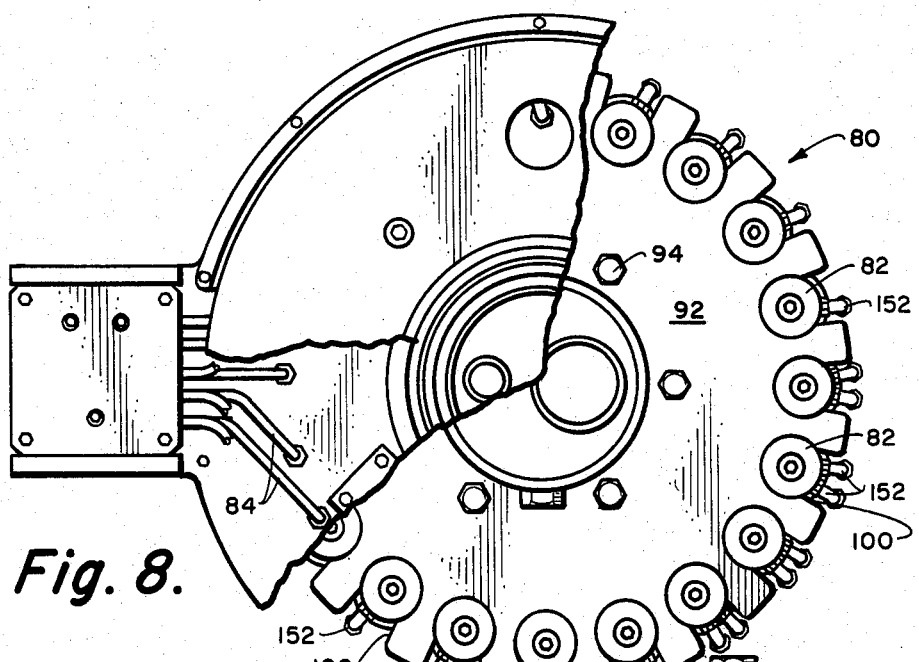
FIG. 8 is a plan view of FIG. 6 partially broken away to show more detail of the control manifold.
Figure 9:
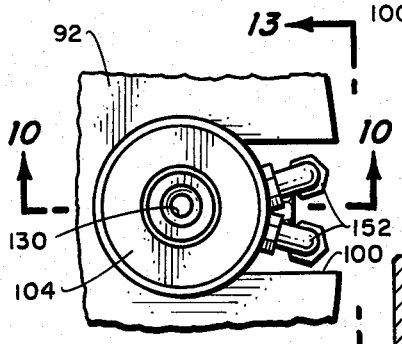
FIG. 9 is a top plan view of one valve cartridge and a portion of the cartridge support of the manifold enlarged over that of FIG. 7.
Figure 10:
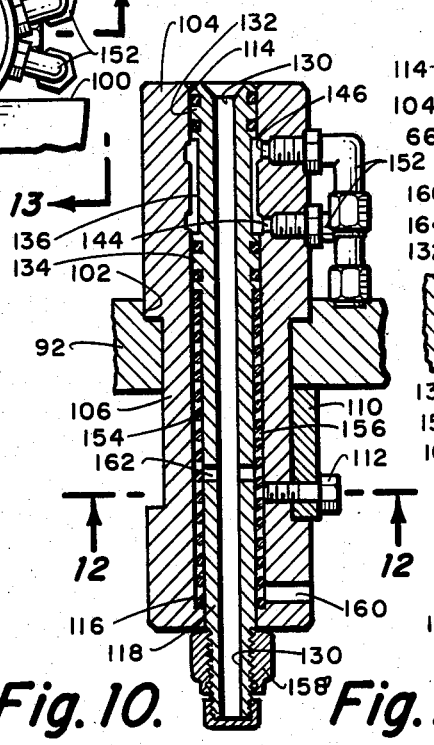
FIG. 10 is an elevational view of the cartridge and support plate taken along line 10—10 of FIG. 9.

Turning first to FIGS. 6–8, it can be seen that the production tree utilizing this invention includes a control tree manifold 80 with a plurality of shuttle type cartridges 82, some of which are double ported and others are single ported, for connection to the production and swab valve operators 18 and 30 via control lines 44 for directing hydraulic fluid from the umbilical 46 or from the running tool 50. FIGS. 6–8 also show the running tool 50 landed on the control tree manifold with its stingers 54 operating the valve cartridge for controlling the various valve operators via control lines 84. (The running tool 50 is locked onto the top of the uppermost production tree block by a locking mechanism 86 engaging a profile 90 formed on the mandrel block for that purpose.) The function of the stingers and the valve cartridge operation will become clear from a more detailed description hereinafter. It should be apparent, however, that the valve cartridges are removable and replaceable, this invention gives flexibility due to the fact that the number of single port and double port valve cartridges can be selected to match the number of functions required of the tree. For example, more double ported control valve cartridges may be selected if more production valve operators are used where more than one production tubing is selected or more single ported valve cartridges may be used if more than one connector is used.

More specifically, the control tree manifold 80 comprises a support plate 92 affixed by bolts 94 to a ledge 96 on the top of a valve block or tree mandrel block. This support plate 92 is centrally apertured for placement on the ledge 96 and is provided with a plurality of slots 100 on its outer edge. These slots 100 open radially outwardly for insertion abnd removal of each of the valve cartridges 82. The top surface and edge of each slot is counterbored to provide a circularly indented seat 102 for each valve cartridge as shown in FIGS. 9, 10, 13 and 14.

Turning now to FIGS. 9–13 where a double ported shuttle valve cartridge is shown in more detail, it can be seen that each valve cartridge comprises an elongated tubular valve body 104 with a reduced outer surface 106 midway of the valve body to fit the circular indented seat 102 on the supporting plate 92. This reduced portion is long enough to receive a semi-circular cylindrical retainer collar 110 which is fastened to the valve body by a set screw 112. The indented seat and the retainer collar located below the support plate together retain the shuttle valve cartridge in place, yet also provide a means for easy removal for repair or replacement, if desired.

Figure 11:
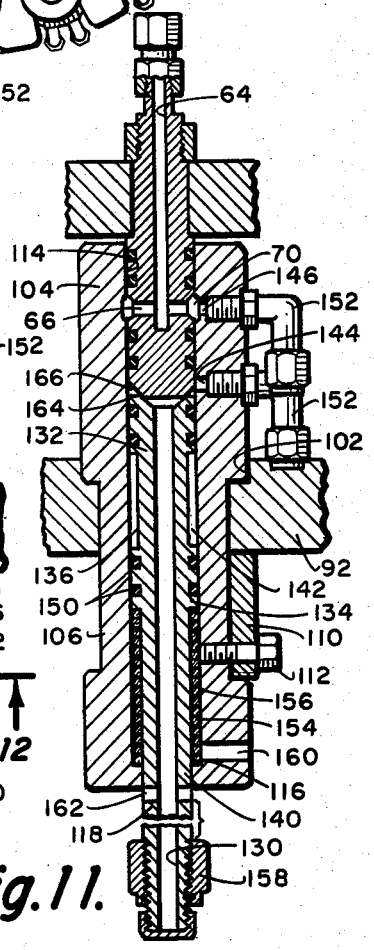
FIG. 11 is an elevational view of the cartridge like FIG. 10, but showing a running tool stinger in place.

The valve body is tubular and provided with a uniform axial valve bore 114 extending the length of the valve body except for a lower shoulder 116 with a shuttle piston 118 axially slideably therein. This piston 118 is longer than the valve body extending beyond the valve body and is itself provided with a uniform axial stem bore 130. The piston contains two spaced apart valve lands 132 and 134 defining a reduced portion 136 and a 140. The valve lands, together with the walls of the axial bore 114, define an annulus 142 that provides communication between a lower inlet port 144 and an upper outlet 146 when the piston is in one (upper) position. These lands 132 and 134 are also provided with suitable sealing rings 150 in conventional grooves to sealingly engage the bore and the inlet and outlet ports 144 and 146 are connected by conventional elbows 152 to the control lines 44 and umbilical 44. The piston is biased towards the upper position by a helical spring 154 which surrounds the reduced stem 140 and engages the lower land 132 as well as the lower shoulder 116. The reduced stem being smaller than the axial valve bore 114 defines a second annulus 156 to contain the spring and is long enough to extend out the lower end of the valve body and is threaded to receive a nut 158 on the lower end thereof. This nut engages the bottom of the valve body and provides a stop means for further upward movement of the piston by operation of the spring. The second annulus 156 containing the spring is vented by a radial bore 160 on the valve body and the piston is also provided by a radial bore 162 located so as to lock the piston in position via a pin or other tool during assembly and stack up tests as illustrated in FIG. 11. The piston is also provided by a stem bore 130 allowing any sea umbilical connector or other device connected between the inlet port 144 and production control unit to be flushed to provide a clean hydraulic circuit in case this circuit's other end was open to the sea during installation. In the first case, individual stingers not connected to the running tool shown may be used to accomplish this task.

As can be seen when the piston is in the upper most position the U-function of the valve cap is now performed by the annulus 142 and the valve body member. Fluid under pressure entering inlet port 144 will be directed at the annulus 142 out the outlet port to the control lines 44. On the other hand, if the running tool 50 is used to place the tree in a workover mode, the previously discussed stingers adapted to fit into axial bore 114 in the valve body will urge the piston to the second position by overcoming the resistance of the spring bias. In this position, the axial passage 64 of the stinger communicates through its radial passage 66 annulus 70 to the outlet 146. In this position too, the hydraulic fluid from the umbilical 46, i.e., inlet 144, is blocked by the lower end of the stinger for seawater intrusion.

The number of such double ported valve cartridges depends on the number of U-functions to be performed that would have been performed by the tree and the support plate modified if need be to accommodate additional valve cartridges. For those functions which are accessible by the running tool only, there is provided a valve cartridge 104A similar in function to the cartridge 104 illustrated in FIG. 13 (and therefore given the same reference numeral with the suffix A), except that only a single outlet port 146 is provided accessible only by the stinger from the running tool. The position of the outlet port of valve cartridge 104A corresponds to the similar position of the outlet port of valve cartridge 104 so that the same configuration of stinger may be used in both cartridge types. The number of such single ported valve cartridges depends on the requirements of the tree, and are used as explained above for those valve and connector operators which are to be controlled only through the running tool 50 such as the wellhead connector 14.

From the foregoing it can be seen that the new and improved tree is provided with a control manifold which itself provides the functions of the combination of tree manifold and tree cap of the prior art, and cooperates with the running tool in the same manner as the manifold of the prior art. In addition, with this invention the control manifold ports are closed to the sea environment when the running tool is removed and the control manifold made ready for the production mode. Also, it becomes apparent that the operability of the valve can be visually determined by the extension or retraction of the valve stem. Furthermore, when the running tool has been landed on the control manifold, means are provided to allow purging of the umbilical lines and/or bleeding of the line(s) controlling the valve operators and the subsurface safety valve(s) by reason of the position of the inlet port 144 and the tapered frontal surface 164 of the stinger (which acts as a valve seat for the piston) so the fluid in the inlet port 144 may enter the space 166 between the end of the piston, the tapered frontal surface and wall of the valve bore 114, and urge the piston off the valve seat venting the inlet 144 to low pressure through the stem axial bore 130 and the radial passage 66 in the valve stem which at this time is below the cartridge body. Further, in case of an emergency disconnect, retrieving the running tool stingers 56 (one shown) while pressurizing to position the production valves 18, the piston 134 will return one and safely vent the fluid trapped in the operator back through the sea umbilical thus avoiding this operator to be hydraulically blocked in open position preventing the fail safe valve closure.

I claim:

1. In a subsea completion tree for the injection, use or production of oil or gas from a subsea well having valve operators actuated by hydraulic fluid and other devices actuated by hydraulic fluid to control the flow of oil or gas from the well, to connect the tree to the well and flowlines, etc., from a remote source of fluid under pressure directed to said tree in two paths, the improvement comprising;

a control manifold as part of said tree for controlling and directing the flow of said hydraulic fluid from either path to the valve operators and to the other hydraulically actuated devices, said control manifold including, supporting means, a plurality of shuttle type valve cartridges each having a body member with an axial bore and a moveable piston therein, each body member being removably affixed to said supporting means, said supporting means being such that the number and type of cartridges may be selected and/or replaced as desired, an outlet in each body member and an inlet in some body members, each piston in one position connected the inlet of those body members having an inlet to the outlet of the same body member for directing said hydraulic fluid from one path to said valve operators, each piston being spring biased to said one position, said pistons being positioned so as to be subject to means for moving each of said pistons against said spring bias to a second position thereby disconnecting said inlets from said outlets, and thereby connecting each outlet in each body member with said moving means for directing hydraulic fluid from a second path to said valve operators and to the other hydraulically actuated devices.

2. The subsea completion tree as claimed in claim 1 wherein each said body member is open at one end and each of said pistons close said one open end of said body members in one position protecting said inlets and outlets from the ambient sea.

3. The subsea completion tree as claimed in claim 2 wherein said pistons extend beyond the other end of said body members in either position indicating the position of said pistons.

4. The subsea completion tree as claimed in claim 3 wherein said pistons each comprise a pair of spaced apart lands sealingly engaging the side wall of its respective body member and defining an annulus therebetween, said annulus being of a length to connect the inlet with the outlet in those body members having an outlet.

5. The subsea completion tree as claimed in claim 4 wherein said supporting means is a plate having peripheral grooves thereon wherein each body member is mounted in said grooves.

6. The subsea completion tree as claimed in claim 5 further including clamping means for affixing said body members in said peripheral grooves.

7. In a system for the production of oil or gas from a subsea well, including a completion tree having valve operators actuated by hydraulic fluid and other devices actuated by hydraulic fluid to control the flow of oil or gas from the well, to connect the tree to the well, etc., from a remote source of hydraulic fluid under pressure directed to said tree in two paths for two different operational scenarios, the improvement comprising;

a control manifold as part of said tree for controlling and directing the flow of said hydraulic fluid from either path to the valve operators and to the other hydraulically actuated devices, said control manifold including, supporting means, a plurality of shuttle type valve cartridges each having a body member with an axial bore and a moveable piston therein, each body member being removably affixed to said supporting means, said supporting means being such that the number and type of cartridges may be selected and/or replaced as desired, an outlet in each body member and an inlet in some body members, each piston in one position connecting the inlet of those body members having an inlet to the outlet of the same body member for directing said hydraulic fluid from one path to said valve operators, each piston being spring biased to said one position, a running tool forming a second path of hydraulic fluid under pressure and having a base with stingers extending downwardly therefrom such that, when said base is adjacent said supporting means, each of said pistons is moved against said spring bias to a second position thereby disconnecting said inlets from said outlets, and thereby connecting each outlet in each body member with said stingers for directing hydraulic fluid from the second path to said valve operators and to the other hydraulically actuated devices.

8. The system as claimed in claim 7 wherein each body member is open at one end to receive a stinger and wherein each of said pistons close said open end of said body members in one position protecting said inlets and outlets from the ambient sea.

9. The system as claimed in claim 8 wherein each stinger comprises a cylindrical spool axially bored to communicate at one end with said source of hydraulic fluid under pressure and open at the opposite end to direct fluid into said outlets in said body members when said pistons have been moved by said stingers to said second position.

10. The system as claimed in claim 9 wherein said pistons each comprise a pair of spaced apart lands sealingly engaging the side wall of its respective body member and defining an annulus therebetween, said annulus being of a length to connect the inlet with the outlet in those body members having an outlet and wherever said outlets are positioned with respect to said open ends so as to be exposed to the hydraulic fluid from said stinger.

11. A shuttle type valve cartridge for use in a subsea type completion tree comprising, a body member having an axial bore with a moveable piston therein, said body member adapted to be removably affixed to a supporting means on said tree, said body member being open at one end thereby forming one inlet to said body member, but which is closed by said piston in one position protecting said bore from the ambient sea, said piston being spring biased to said one position, an outlet in said body member, said piston being positioned in said bore so as to be subject to means for moving said piston against said spring bias to a second position thereby connecting said outlet with said moving means for directing hydraulic fluid from one path to valve operators and other hydraulically operated devices in said tree.

12. The valve cartridge claimed in claim 11 wherein said body member has a second inlet, said inlet being in communication with said outlet when said piston is in said one position for directing hydraulic fluid from a second path to said valve operators, said inlet being out of communication with said outlet when said piston is in said second position.

13. In a subsea completion tree for the injection, use or production of oil or gas from a subsea well having valve operators actuatable by hydraulic fluid and other devices actuatable by hydraulic fluid to control the flow of oil or gas from the well, to connect the tree to the well and flowlines, etc., from a remote source of fluid under pressure directed to said tree in two paths, the improvement comprising;

a control manifold as part of said tree for controlling and directing the flow of said hydraulic fluid from either path to the valve operators and to the other hydraulically actuated devices, said control manifold including, a plate having peripheral grooves, a plurality of shuttle type valve cartridges each having an axial bore and a body member with a moveable piston therein, clamping means for removably affixing said cartridges within said peripheral grooves so that said cartridges may be removed or replaced, an outlet in each body member and an inlet in some body members, and said piston in one position connecting the inlet of those body members having an inlet to the outlet of the same body member for directing said hydraulic fluid from one path to said valve operators, said pistons being positioned so as to be subject to means for moving each said pistons to a second position thereby disconnecting said inlets from said outlets, said moving means having means forming the other path for connecting said fluid under pressure to said outlets for said valve operators and to the other hydraulically operated devices.

* * * * *